US007612787B2

(12) United States Patent
Kienhoefer

(10) Patent No.: US 7,612,787 B2
(45) Date of Patent: Nov. 3, 2009

(54) METHOD AND DEVICE FOR OPERATING A DISPLAY AFFLICTED WITH WEAR

(75) Inventor: Carsten Kienhoefer, Karlsruhe (DE)

(73) Assignee: Ingenieurbuero Kienhoefer GmbH, Karlsruhe (DE)

( * ) Notice: Subject to any disclaimer, the term of this patent is extended or adjusted under 35 U.S.C. 154(b) by 568 days.

(21) Appl. No.: 10/579,634

(22) PCT Filed: Nov. 13, 2004

(86) PCT No.: PCT/DE2004/002517

§ 371 (c)(1),
(2), (4) Date: May 17, 2006

(87) PCT Pub. No.: WO2005/052903

PCT Pub. Date: Jun. 9, 2005

(65) Prior Publication Data

US 2007/0146385 A1 Jun. 28, 2007

(30) Foreign Application Priority Data

Nov. 24, 2003 (DE) ..... 103 54 820

(51) Int. Cl.
*G09G 5/10* (2006.01)

(52) U.S. Cl. ..... 345/690; 345/600

(58) Field of Classification Search ..... 345/214–215, 345/593, 600–690
See application file for complete search history.

(56) References Cited

U.S. PATENT DOCUMENTS 5,821,917 A 10/1998 Cappels et al.
6,501,230 B1 12/2002 Feldman
6,911,781 B2 * 6/2005 Yamazaki et al. ..... 315/169.3
7,456,827 B2 * 11/2008 Rosmalen ..... 345/204

(Continued)

FOREIGN PATENT DOCUMENTS

DE 100 10 964 A1 3/2000

(Continued)

*Primary Examiner*—Henry N Tran
*Assistant Examiner*—Christopher E Leiby
(74) *Attorney, Agent, or Firm*—Harness, Dickey & Pierce, P.L.C.

(57) ABSTRACT

The invention concerns a display (1) afflicted with wear, and to a method for operating a display (1) of this type. In conjunction with the problems associated with the burning in of non-moving images or image elements in wear-afflicted displays, particularly plasma displays, and with the problems associated with the wear-characteristics, which differ in the individual primary colors red, green and blue, of the phosphorous cells of a display (1) of this type whereby resulting in a shift in the color temperature of the image reproduction, the invention provides that the latest pixel wear values (R*, G*, B*) are written into a memory element (3), whereby pixel correction values are determined by means of a logic element (2), which is assigned to this memory element (3), and corrected pixel values R', G', B' are generated from these pixel correction values and are applied to the display (1) for homogenizing the individual pixel wear values. According to the invention, a two-stage memory element having a volatile and a non-volatile memory (5 and 6) is used that stores the enormous volumes of data resulting from this context. The inventive solution also works with at least two temporally decoupled cycles for determining the pixel wear values and for determining the pixel correction values.

33 Claims, 3 Drawing Sheets

U.S. PATENT DOCUMENTS

Figure 1:
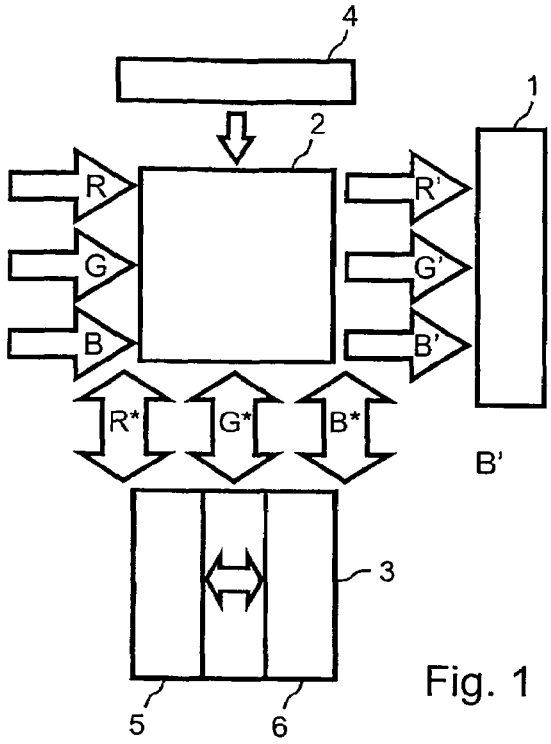

| | | | |
|---|---|---|---|
| 2002/0033783 | A1 | 3/2002 | Koyama |
| 2003/0011539 | A1 | 1/2003 | Kubota |
| 2003/0063053 | A1 | 4/2003 | Yamazaki |
| 2003/0071804 | A1 | 4/2003 | Yamazaki et al. |

FOREIGN PATENT DOCUMENTS

| | | | |
|---|---|---|---|
| DE | 101 13 248 | A1 | 10/2002 |
| EP | 0 661 726 | A1 | 7/1995 |
| EP | 0 702 347 | A | 3/1996 |
| EP | 0 755 042 | A1 | 1/1997 |
| EP | 1 376 520 | A1 | 1/2004 |
| JP | 2002-006796 | | 1/2002 |

* cited by examiner

METHOD AND DEVICE FOR OPERATING A DISPLAY AFFLICTED WITH WEAR

This application is the national phase under 35 U.S.C. § 371 of PCT International Application No. PCT/DE2004/002517 which has an International filing date of Nov. 13, 2004, which designated the United States of America and which claims priority on German Patent Application 103 54 820.3 filed Nov. 24, 2003, the entire contents of which are hereby incorporated herein by reference.

The invention concerns a wear-afflicted display and a process for operating a wear-afflicted display, in particular a plasma display panel, FED, or an organic display, with defined pixels, in which each pixel is allocated a memory address in a memory element for recording the operating time of each pixel and is furthermore integrated over the operating time and the operating intensity in order to determine a pixel wear value, and a pixel wear value and/or a characteristic that is proportional to the respective pixel wear values is stored for each pixel, and in addition a corrective signal for the equalization of the pixel wear is generated based on the evaluation of the respective pixel wear values by means of at least one logic element.

A display such as this is known from U.S. patent application No. 2003/0063053 A1, in which the wear and display times are recorded for each individual pixel. From the recorded values are calculated correction values, with the aid of which the brightness of each individual pixel can be adapted in such a way that a low wear occurs. These values are saved regularly in the memory elements respectively allocated to the image elements, so that the actual status of the display can be used to calculate the correction values. A comparison of adjacent pixels can thus be made, based on which an equalization of the brightness and the wear of the display is possible. The brightness is controlled in such a way via the power supply of the individual pixels that it can only fluctuate within predetermined limits, and in particular does not exceed a predetermined limit. A correction of already existing irregular wear can be achieved by way of an intentional higher wear of the otherwise less worn pixels.

Likewise already known is a display described in German patent publication DE 100 10 964 A1, in which it is differentiated between the operations for each of the colors red, green, and blue for each pixel. This display is characterized especially in that the individual monochrome pixels are not of equal size, but are adapted in size to the wear of the corresponding colored phosphorous display. Furthermore, it is provided therein to monitor and equalize the actual wear of the individual pixels similarly as in the previously described process with the object of a white compensation.

A process for protecting against the pixels burning-in into the plasma display is also known from the abstract of the Japanese patent application JP 2002091373.

In this previously known process, the display time of each pixel of a display is recorded. A video signal is then generated in dependence upon predetermined difference values or threshold values and is made to be displayed on the display in order to configure approximately uniformly the display time of each phosphorous element of the display.

The previously mentioned plasma display panels, called for short PDPs, consist essentially of two glass panes, which are assembled together with a precise fit. Between the two glass substrates are arranged cells, which are filled with a noble gas, preferably neon or xenon. In the lower substrate, these cells are coated with phosphorous in the basic colors red, green, and blue. Thin electrodes are applied on the lower and upper transparent glass substrates. A voltage, which generates the ultraviolet radiation that is applied for controlling a discharge process on the mentioned electrodes, is generated with a plasma pulse generator. This ultraviolet radiation causes the phosphorous coating of the display to glow. Each color can then be generated by means of a combination of the basic colors red, green, and blue. Depending on the content of the image is thus addressed each one of the individually separated color cells.

The particular advantages-of the plasma technology rest in the high image brightness that can be obtained, which is exclusively limited by the consumption of the phosphorous and allows an observation angle of at least 160 degrees. Furthermore, the eventual plasma displays have excellent contrast values, while a good black value of the image representation and/or an eventually desired color correction, possibly by preventing an orange sting, can be achieved by means of a corresponding tinge of the frontal substrate or by using a suitable filter element arranged upstream.

However, these plasma displays have disadvantages that are immanent to the system. Similarly as for the tube monitor, the phosphorous represents a consumption agent that limits the life expectancy of the display. If upright images are represented for a long time on the display, the phosphorous and the displayed picture burn themselves into the display.

The luminance of the phosphorous and also the brightness and the contrast of the plasma display disappear inevitably with each operating hour.

The manufacturers of plasma display panels currently recommend the use of screensavers in order to mitigate or prevent the described burn-in effect. However, it is a concern that the effect can occur also with running or moving images, such as perhaps feature films, possibly if the logo of a television station or the known black bars are permanently displayed at the edge of the picture, and the problem of a partially increased or reduced wear occurs thus in this display section.

Furthermore, it must be taken into consideration with regard to the wear characteristic of phosphorous that the wear characteristic of the basic colors red, green, and blue of phosphorous differ from each other, so that the color temperature range of a display can indeed change over its service life. The use of screensavers provides no useful effect with regard to this problematic.

As an alternative are known further processes, such as possibly image shifting—a method of intentional image scrolling for equalizing the wear—or an automatic brightness reduction in stills.

From JP 2002006796 A is known a further process for improving the long-term behavior of the plasma display. The individual operating times of the red, green, or blue phosphorous elements for the entire display can be analyzed according to this process by recording a time integral for each pixel. Correction signals for each of the three basic colors red, green, and blue can be generated based on these determined wear values in order to keep the brightness and the color temperature of the display constant, if possible over long periods of time. The indication of the red, green, and blue graphic data forwarded within an image file is then corrected during the further activation of the display by means of the mentioned correction signals. A separate wear analysis for each pixel and a corresponding separate correction of each pixel correction of the wear is not provided. The different pixel loading can thus not be ignored within the scope of the previously known process.

From DE 43 34 640 A1, it is known in connection with the previously explained problematic to automatically display so-called inverse images instead of the already mentioned screensavers through a corresponding inverse switching when defined threshold values are reached. The display or the inverse switching of the respectively displayed image is carried out in dependence upon temporal specifications or otherwise predeterminable parameters. An analysis or recordation of the pixel wear is not provided herein.

Based on this state of the art, it is an object of the invention to create a wear-afflicted display or a process for operating such a display, with which a constant image quality can be achieved over a long time period or the service life of the display can be extended.

This object is attained with a process according to claim 1 or with a display according to claim 31. Advantageous embodiments of the invention result according to the dependent claims 2 to 30 as well as 32 to 34.

As already mentioned, in wear-afflicted displays, especially plasma displays, there exists the problem that specific partial areas are more frequently or intensively utilized and the monitor can consequently be damaged by means of a so-called burn-in. Furthermore, it should be noted that the wear of the phosphorous with reference to the basic colors red, green, and blue is differently represented, so that the wear of the basic colors is different. The previously described effects can be eliminated or mitigated based on the use of the process of the invention and a possibility can even be created for equalizing the partial wear. For this purpose, the activation of the individual pixels is adapted within the scope of the invention to the wear in the current status of the display. In the first hours of operation, in which the burn-in effect is greatest, the pixels are therefore loaded with a particularly low brightness value in comparison with conventional displays. With increasing wear, the brightness is then continuously increased according to a stored characteristic curve or characteristic field. In order to prevent the different wear of the basic colors, the operating time and operating intensity according to the basic colors red, green, and blue is separately recorded and a pixel wear value or a characteristic that is proportional to this pixel wear value is stored for each pixel by means of a memory element that is clearly allocated to each pixel.

A correction of the graphic data to be displayed can be carried out for each separate pixel by means of these data with the object of reducing, equalizing, or preventing the wear on the plasma display. It should be noted herein that in a typical plasma color display is used an image repetition frequency of usually up to 60 Hz, while resolutions of 1280×780 pixels or higher are used, so that a constant data flow of after all 177 MB per second accumulates with a color depth of 8 bit per color. This data flow must then be processed and stored, for example, by integration. The value to be stored is clearly over 8 bit per color. Already the simple adding of one 8 bit color value over a period of 4 minutes requires a memory of 22 bit per color point. A data flow of 1.5 GB per second is probably required if the memory value must not only be read but also written.

The invention solves the problem of the considerable data flow that is to be processed by means of an intelligent data management.

For this purpose, according to claim 1, the permanent integration of the pixel wear for each individual pixel is completely decoupled from the determination of the pixel correction values resulting from it, so that a rapid cycle is available to determine the current pixel wear and a temporally decoupled, clearly slower cycle with correspondingly reduced processor performance can be used to determine the correction value of individual pixels. For this purpose is used a two-stage memory element, which comprises a volatile and a non-volatile memory. The use of the volatile memory is offered from the technical point of view based on the speed of this memory element, since the decoupling of the cycles that is attained in this way, and in particular the forgoing of a permanent or synchronous calculation of the correction values, represents an effective contribution to the reduction of the processor load and of the volume of data to be processed. Furthermore, volatile memory elements are more advantageous than non-volatile memory elements. In addition, typical non-volatile memories have generally a maximum allowable number of deletion cycles, which can be clearly below the service life of the PDPs in fast memory cycles.

Within the scope of the invention, the volatile memory element is not only used for the enlargement of the available memory space, but rather almost as an overflow for processing the described, considerably accruing volume of data. In this way, within the scope of the invention, the accruing pixel wear values are initially written into the volatile memory in a first memory step, and are transferred into the non-volatile memory only in a second memory step. In the correct understanding of the memory space management, it should be assumed that the previously explained cycles of the storage are decoupled from each other and run asynchronously.

In this way, it has been shown to be advantageous to not secure the data in case of a shutdown of the display, so that the components of the invention do not require a measure that requires a power supply such as, for example, a buffer accumulator. The inaccuracy resulting from this can be disregarded. A continuous transfer of data is otherwise carried out from the volatile memory into the non-volatile memory in the operation of the display.

When the display is turned on, the data that are retained in the non-volatile memory are then rewritten into the volatile memory in a first step in order to later write these data in the access of the memories that are required for the wear-reducing operation of the display.

In an advantageous embodiment, the memory is immediately started, at first without the corresponding correction of the image graphic data, regardless of the fact that the rewriting process of the data into the volatile memory is not immediately completed.

In the practice, it has been shown to be advantageous if one or several SDRAM components are used as volatile memory element and one or several flash components are used as non-volatile memory element.

Aside from the use of a volatile or non-volatile memory element, it has been shown to be advantageous if the volume of data to be processed is reduced by means of a correspondingly skilled data processing. This can occur, for example, by reducing the accuracy of the respectively recorded pixel wear values, for example, by not storing the bit with the respectively lowest value, the so-called "least significant bit"—"lsb"—or instead of an absolute amount, which represents the current pixel wear value, storing a difference value between the respective pixel wear value and a predetermined (for example, maximum, minimum, or medium) pixel wear value. In this way results a reduction of the stored volume of data insofar as the difference value becomes lower as usual than the absolute value that is otherwise to be stored.

In order to address the different wear characteristics of the phosphorous elements in the basic colors red, green, and blue, it has proven advantageous if the intensity of the activation of the individual pixels is recorded individually for each pixel or separately by sections for each of the basic colors red, green, and blue.

In a further process step takes then place, depending on the recordation of the aforementioned data, a correction of the graphic data to be displayed in dependence upon the reaching of predetermined threshold values, while the increase and/or reduction of the intensity of the display of the individual pixels can be carried out automatically, interactively, and/or manually.

In a likewise advantageous embodiment can be generated a correction image, whose indication leads to the fact that the different individual pixel wear values are raised to a general wear level as repair measure for a wear-afflicted display. The plasma display is again equalized after the corresponding indication of the correction image and the original color temperature of the display is preferably restored.

Also the display of the correction image can be carried out automatically, interactively, and/or manually in dependence upon predetermined threshold values.

In order to accelerate the previously described repair of the plasma display or the equalization of the pixel wear values, it may be practical to activate at least selected individual pixels above the otherwise maximum allowable or at least operate with increased image brightness.

In order to be able to carry out the previously described corrections, it is practical if at least one logic element, which multiplies the red, green, and blue image graphic by means of the correction data generated by the logic element(s), is allocated to the memory element that is necessary for the recordation of the pixel wear values, and the display is activated in the following with the correspondingly corrected graphic data.

The correction data are determined based on the evaluation of the pixel wear values stored in the memory element allocated to the display and/or form characteristic fields.

The generation of the correction values must therefore not occur permanently, but can occur at intervals or by cycles. It is sufficient if the correction values are generated possibly multiple times per hour and the work is carried out afterward with these corrective values until the next determination of the correction values. These measures represent an effective method for reaching the required processing speed. The cycles for feeding the pixel wear values and their integral summation occur also decoupled from the determination of the correction data.

The determination of the correction data can of course be carried out in dependence upon further predetermined parameters, such as possibly the individual phosphorous characteristic of the separately used display, the allowed brightness of the display, or also the total brightness of the display separated according to the basic individual colors red, green, and blue. The current operating temperature of the individual display, the age of the display, as well as the color temperature, and also the limited maximum brightness are further parameters, which can be taken into consideration in connection with the determination of the correction data from the mentioned logic.

The process of the invention can also be advantageously used to retrofit already existing displays, in particular plasma displays, by retroactively allocating a memory element pursuant to the invention and at least one corresponding logic element to these displays, wherein an evaluation of the individual wear status of the retrofitted display is carried out in a first process step and a first correction step is then conducted. In addition to this, a transfer into a wear-protected constant operation can take place according to what was previously described.

It has also been shown to be advantageous in display technologies that have highly differentiated wear characteristics, such as, for example, in OLED displays, to proportionately increasingly display the corresponding colors or the corresponding color and to activate these less in the beginning with the aid of the corrected pixel values (R', G', B') by means of this process, and only to correct them over time. In this way, these display technologies achieve a longer and/or a required service life and/or a higher total brightness.

It has also been shown to be advantageous if the display is possibly scalable with regard to the picture resolution and can thus be adapted to the individually changing conditions based on the different operating time.

It has also been shown to be advantageous in the process to integrate into the logic element(s) (2) the logic of a graphic controller without the otherwise customary graphic memory and thus to be able to jointly utilize the volatile memory.

As additional or alternative correction possibility can be utilized the plasma pulse generator that is allocated to the display by forwarding the correction data that are predetermined by the logic directly to the plasma pulse generator and producing thus a special brightness control of the pixels of the display in the plasma pulse generator, which is individual to each pixel, in dependence upon these correction data, and incidentally applying the otherwise unchanged graphic data on the RGB input of the display.

The process according to the invention can be advantageously operated in this way with the known processes for wear-protected operation of such displays, in which it has also been shown to be advantageous if the process according to the invention is connected downstream or as a subordinate control circuit.

The process of the invention is advantageously used in connection with a wear-afflicted display pursuant to the features of claim 31. This wear-afflicted display is characterized in that a memory element for recording the individual pixel wear values is allocated to each pixel and corrected RGB graphic data are generated from the pixel wear values by means of at least one logic element and are applied at the input of the display.

As an alternative, or in addition, the plasma pulse generator of the wear-afflicted display can be used for the previously described individual pixel brightness control of the display.

Figure 2:
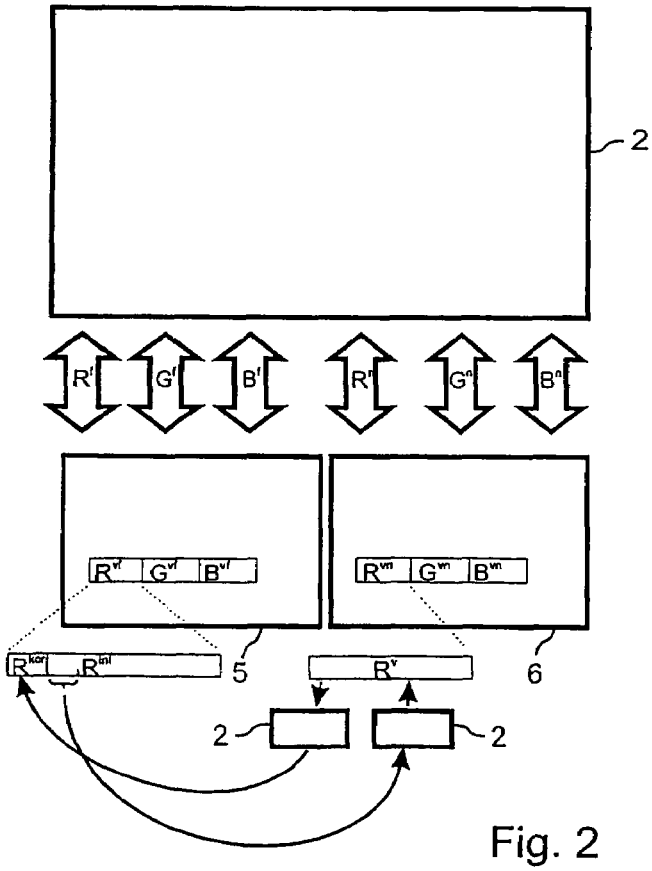
Figure 3:
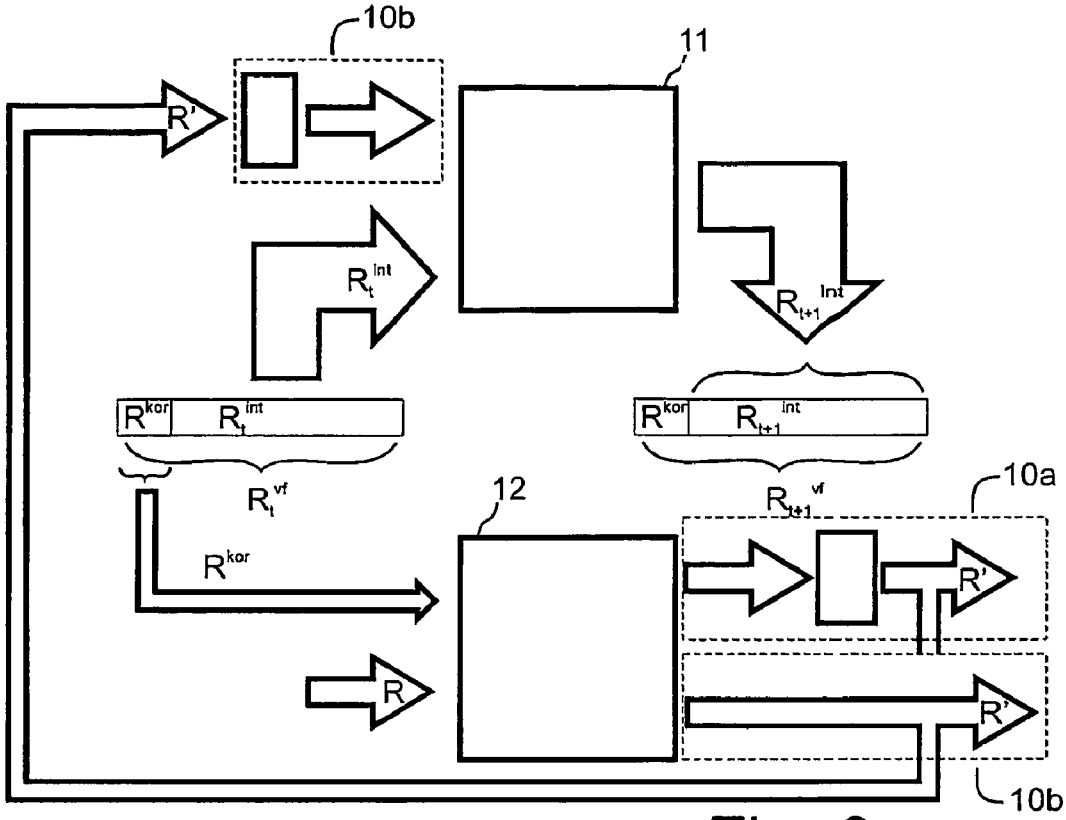
Figure 5:
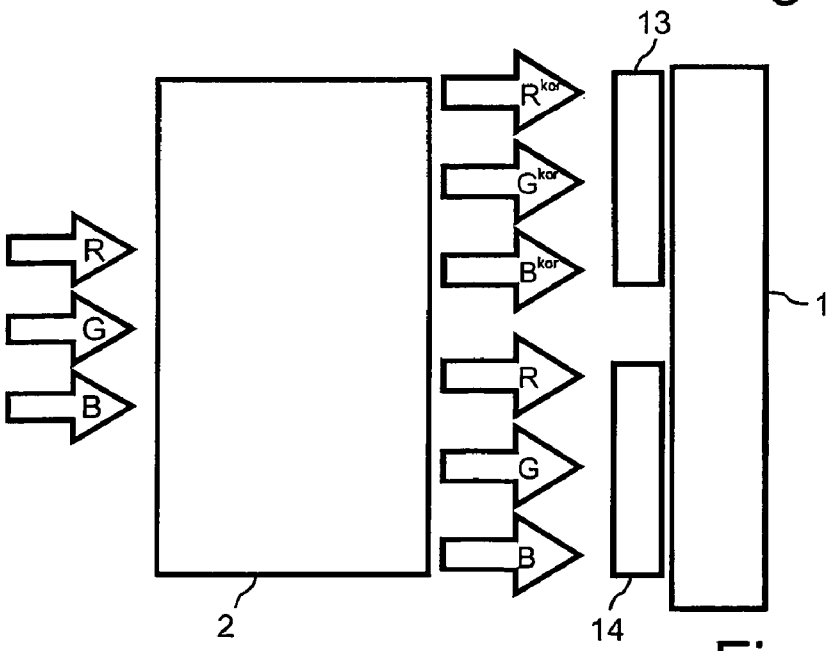
Figure 4:
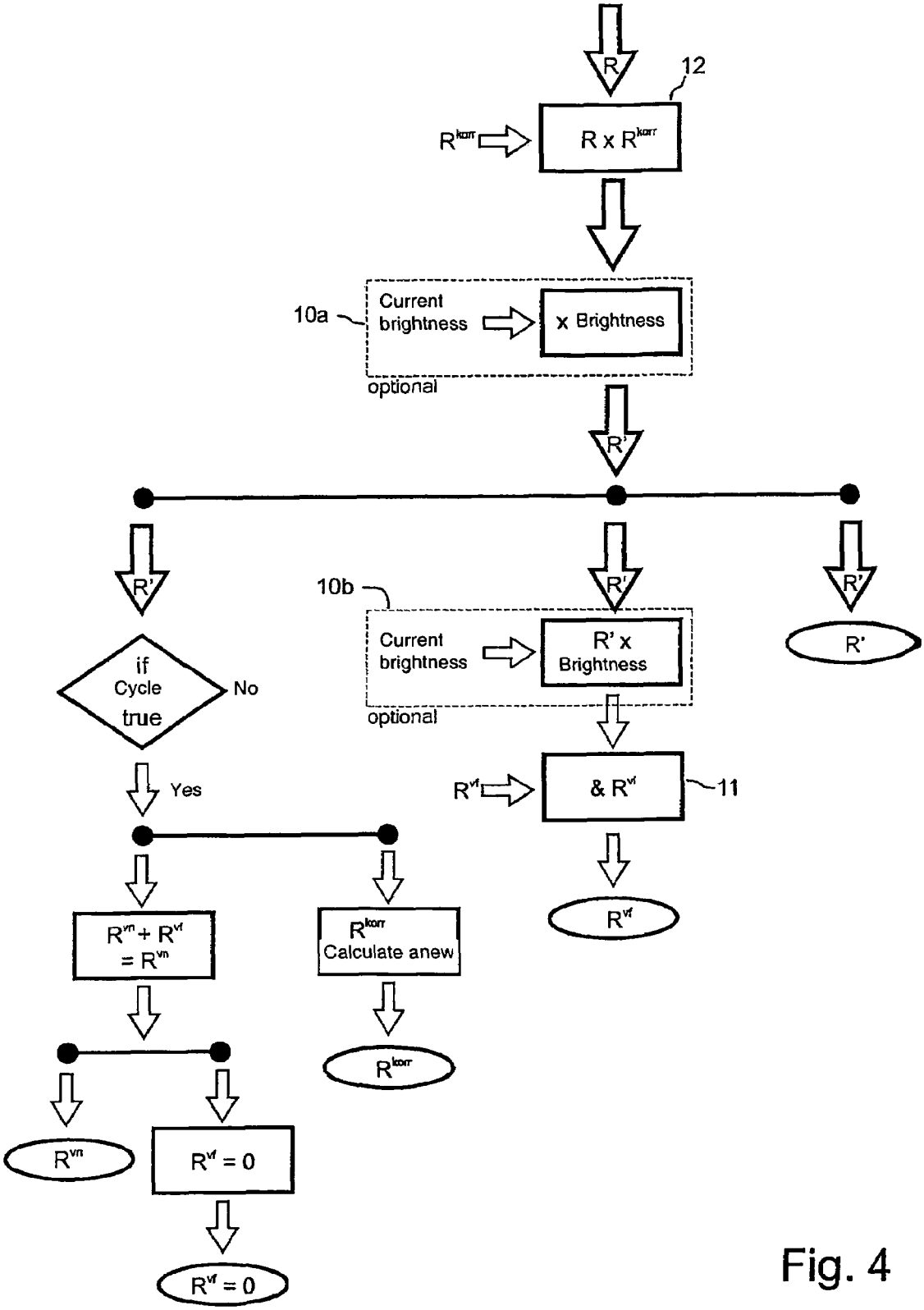

The invention will be described in the following with reference to several exemplary embodiments, wherein:

FIG. 1: shows a block circuit diagram of a plasma display panel (PDP) with memory and logic element, FIG. 2: shows a functional diagram for data transfer between logic element and memory element, FIG. 3: shows a diagram of the process for determining the corrected graphic data in the logic element, FIG. 4: shows a further diagram of the process for determining the corrected graphic data in the logic element, and FIG. 5: shows an alternative modulation of the plasma pulse generator of a display in a block circuit diagram.

FIG. 1 shows a block circuit diagram of a wear-afflicted display 1, which in the exemplary embodiment should be a so-called plasma display panel, PDP for short. The display 1 is in data connection with at least one logic element 2, that is, possibly and ASIC, FPGA, or an otherwise integrated IC circuit, and a memory element 3. To the logic element(s) 2 is allocated in addition a parameter memory 4, which can consist of a connected external memory. As an alternative, the parameter memory 4 can be realized also as partial element of the non-volatile memory 6. In the parameter memory 4 can perhaps be stored the individual phosphorous characteristic of the PDP display 1.

The memory element 3 allocated to the display 1 consists of a volatile memory 5 and a non-volatile memory 6. The volatile memory 5 is comprised by one or multiple SDRAM components and the non-volatile memory 6 is comprised by one or multiple flash memories.

In the memory element 3, each pixel of the display 1 is assigned a fixed memory space or a defined memory address. Individual pixel wear values R*, G*, B* are separately written into the memory element 3 for each pixel according to the basic colors red, green, and blue. The pixel wear values R*, G*, B* that are individual to each pixel are thus written into the volatile memory 5 in a first storage step and are continuously rewritten in the non-volatile memory 6 during operation. The buffering of the non-volatile memory 6 with a volatile memory 5 is offered from the technical and economical point of view because of the considerable volume of data that are produced.

The display 1 serves for displaying graphic data, that is, for example, in a plasma TV, the display of the pixel data R, G, B supplied by the television station. The pixel data R, G, B can also be forwarded separately according to the basic colors red, green, and blue, so that it can also be differentiated between the three colors with regard to the pixel data R, G, B. In contrast to the conventional displays, the display 1 pursuant to the invention is not operated with the pixel data forwarded by the television station, but rather with corrected pixel data R', G', B'. The corrected pixel data R', G', B' are calculated by the digital logic element 2, taking into consideration the parameters located in the parameter memory 4, such as possibly the individual phosphorous characteristic of the display 1, and the pixel wear values R*, G*, B* located in the memory element 3.

The storage of the individual pixel wear values R*, G*, B* and the interaction of memory element 3 and logic element 2 are shown in more detail in FIG. 2.

As already mentioned, the memory element 3 comprises a volatile memory 5 and a non-volatile memory 6. Therein, the individual pixel wear values R*, G*, B*, which are proportional to the operating time and intensity of the operation of the respective pixel, are written first as volatile pixel wear values $R^f$, $G^f$, and $B^f$ in the volatile memory 5. The most significant bits of the pixel wear values $R^a$, $G^a$, $B^a$ are written into the non-volatile memory 6 in terms of an overflow.

The pixel wear values that are written into the memory elements 5 and 6 are constantly integrated over the operating time of the respective pixel by means of a corresponding addition loop, and from these are generated integral values, such as perhaps $R^{int}$, then real pixel wear values $R^v$, $G^v$, and $B^v$, which are then stored depending on the value in the volatile memory 5 as $R^{vf}$, $G^{vf}$, and $B^{vf}$, or in the non-volatile memory 6 as $R^{vn}$, $G^{vn}$, and $B^{vn}$, and the previous value $R^{int}$, $G^{int}$, and $B^{int}$ is reset. From the stored values is determined an individual pixel correction signal $R^{kor}$, $G^{kor}$, or $B^{kor}$ by means of the logic element. By means of these correction signals are then determined, as already mentioned in connection with FIG. 1, the corrected pixel data R', B', and G'.

Furthermore, the logic element 2 ensures that the data stored in the non-volatile memory 6 are first rewritten into the volatile memory 5 when the display 1 is turned on. Until then, it is possible of course to operate with an initially uncorrected display indication.

The logic element 2 determines thus correction values $R^{kor}$, $G^{kor}$, or $B^{kor}$ that are individual to each pixel, while taking into consideration the parameter values stored in the parameter memory 4, while the determination of these correction values does not occur continuously but by cycles, that is, possibly at defined intervals or when predetermined threshold values are exceeded.

A careful differentiation must therefore be established between the cycles for determining the corrected pixel data R', B', and G', and the integration cycle for determining the pixel wear values $R^{int}$, $G^{int}$, or $B^{int}$.

According to FIG. 3, the pixel data R, G, B are processed by means of these correction data $R^{kor}$, $G^{kor}$, or $B^{kor}$, and the display 1 is finally loaded with the corrected pixel data R', G', B'.

An example of the determination of the corrected pixel data is shown in detail in the flow diagram shown in FIG. 3.

FIG. 3 shows the processing of a pixel value with the fast cycle for the red channel of a cell. In order to possibly take into consideration the system-induced maximum brightness, the process pursuant to the invention can obtain the information from the control mechanism of the display. Within the scope of the process pursuant to the invention, this mechanism can also be automatically reproduced in that this is taken into consideration with an external multiplier 10*b* for wear determination. The control itself is carried out with an internal multiplier 10*a*.

Initially, the actual pixel value R is supplied together with the correction value $R^{kor}$ to a main multiplier 12. By means of this multiplication of the value R by the individual pixel correction value $R^{kor}$ is additionally generated a corrected pixel value R', which can be optionally corrected by means of the internal multiplier 10*a* that can be connected to the display 1 as well as also to the optional external multiplier 10*b* to generate a corrected value with adjusted brightness. This corrected value, which has an adjusted brightness, is integrated into a loop by means of an integrator 11, and is combined to form an integrated pixel wear value $R^{int}$. From this integrated pixel wear value $R^{int}$ is then determined a correction value $R^{kor}$ by means of the logic element 2, which depending on the individual pixel wear can have a value that is higher or lower than 1. Under this, it should be understood that an increase or a reduction of the pixel wear can be predetermined for the correction value.

The determination of the corrected pixel value R' that is to be ultimately connected to the display is shown again in detail as a process diagram in FIG. 4. According to the representation of FIG. 4, as already mentioned, the actual pixel value R is first fed together with the correction value $R^{kor}$ to the main multiplier 12. By means of this multiplication of the value R by the individual pixel correction value $R^{kor}$ is finally generated a corrected pixel value R', which is optionally still acted on by the internal multiplier 10*a* that is connected to the display 1 as well as also optionally to an external multiplier 10*b* to generate a corrected value with adjusted brightness. This corrected value with adjusted brightness is then integrated into a loop by means of the integrator 11 and is combined to an integrated volatile stored pixel wear value $R^{vf}$. This value is then integrated further with the already previously volatile stored pixel wear values $R^{vf}$ and stored in the volatile memory element as volatile pixel wear value $R^{vf}$.

According to a further parallel loop, it is continuously checked with a slow cycle if a new calculation of the correction data $R^{kor}$ is required, or if the work can be continued with the previous correction data.

It is furthermore ensured with a slow cycle in a further parallel loop that the volatile stored pixel wear values $R^{vf}$ are continuously written into the non-volatile memory as non-volatile stored pixel wear values $R^{vf}$. The forwarding of volatile pixel wear values $R^{vf}$ to the non-volatile pixel wear values $R^{vn}$ does not have to be completed. It has also been shown to be advantageous to only forward the high-value bits, the so-called "most significant bits"—"msbs"—and to leave unchanged the less significant bits until the following slow cycle.

Apart from that, the pixel value R' that is ultimately to be applied on the display can be generated from the correction values $R^{kor}$ determined in the easiest way by multiplication with the optional value with brightness correction. As an alternative, this can also be carried out by means of one or several additions.

According to FIG. 5, the digital logic element 2 can directly supply the plasma pulse generator 13 allocated to the plasma display 1 alternatively or in addition with the pixel correction values $R^{kor}$, $G^{kor}$, $B^{kor}$ generated according to the previous embodiments. In this embodiment, the digital logic element 2 loops the pixel data R, G, B predetermined by the original graphic signal without any change directly through to a RGB input 14 of the display 1.

Finer gradations in the individual pixel brightness control of the plasma display 1 can be carried out in this way.

In the previous was consequently disclosed a process and a device for wear-protected operation of a wear-afflicted display 1, in particular a plasma display, which is characterized in that an individual pixel equalization of the wear level of the display 1 is carried out taking into consideration the individual parameters of the plasma display, in which this process is assisted respectively by an intelligent memory and data management.

LIST OF REFERENCE CHARACTERS

| | |
|---|---|
| 1 | Display |
| 2 | Logic element |
| 3 | Memory element |
| 4 | Parameter memory |
| 5 | Volatile memory |
| 6 | Non-volatile memory |
| 10 | Brightness control |
| 10a | Internal multiplier |
| 10b | External multiplier |
| 11 | Integrator |
| 12 | Main multiplier |
| 13 | Plasma pulse generator |
| 14 | RGB input |
| R, G, B | Pixel data |
| $R^{kor}$, $G^{kor}$, $B^{kor}$ | Pixel correction values |
| R', G', B' | Corrected pixel values |
| R*, G*, B* | Stored pixel wear values |
| $R^{vf}$, $G^{vf}$, $B^{vf}$ | Volatile stored pixel wear values |
| $R^{vn}$, $G^{vn}$, $B^{vn}$ | Non-volatile stored pixel wear values |
| $R^{int}$, $G^{int}$, $B^{int}$ | Integrated pixel wear values |

The invention claimed is:

1. A process for operating a wear-afflicted display having defined pixels, comprising:

assigning each pixel a memory address in a memory element to record an operating time of each pixel, the pixel being integrated over the operating time and operating intensity to determine a pixel wear value ($R^{int}$, $G^{int}$, $B^{int}$);

storing the pixel wear value for each pixel in the form of a non-volatile stored pixel wear value ($R^{vn}$, $G^{vn}$, $B^{vn}$) in a non-volatile memory for each of the three basic colors including red, green, and blue;

obtaining the non-volatile stored pixel wear value ($R^{vn}$, $G^{vn}$, $B^{vn}$) as a sum of the most significant bits integrated over the operating time of the pixel of a pixel wear value ($R^{vf}$, $G^{vf}$, $B^{vf}$) that is volatile stored in a volatile memory, wherein the less significant bits of the volatile stored pixel wear value ($R^{vf}$, $G^{vf}$, $B^{vf}$) are retained unchanged in the volatile memory and the most significant bits of the volatile stored pixel wear values ($R^{vf}$, $G^{vf}$, $B^{vf}$) are transferred to the non-volatile stored pixel wear values ($R^{vn}$, $G^{vn}$, $B^{vn}$).

2. A process for operating a wear-afflicted display having defined pixels, comprising:

Assigning each pixel a memory address in a memory element to record an operating time of each pixel, the pixel being integrated over the operating time and operating intensity to determine a pixel wear value ($R^{int}$, $G^{int}$, $B^{int}$);

Storing the pixel wear value for each pixel in the form of a non-volatile stored wear value ($R^{vn}$, $G^{vn}$, $B^{vn}$) in a non-volatile memory for each of the three basic colors including red, green, and blue;

Obtaining the non-volatile stored pixel wear value ($R^{vn}$, $G^{vn}$, $B^{vn}$) as a sum of the most significant bits integrated over the operating time of the pixel of a pixel wear value ($R^{vf}$, $G^{vf}$, $B^{vf}$) that is volatile stored in a volatile memory, Wherein a correction value ($R^{kor}$, $G^{kor}$, $B^{kor}$) for correcting the respective pixel signal (R, G, B) that is individual to each pixel is stored in the same memory cell ($R^{vf}$, $G^{vf}$, $B^{vf}$) of the volatile memory as the volatile stored pixel wear value ($R^{vf}$, $G^{vf}$, $B^{vf}$), and a characteristic that is proportional to the respective pixel wear values is stored in addition to or alternatively the pixel wear values.

3. The process of claim 1, further comprising carrying out a complete transmission of the data that are retained in the volatile memory to the non-volatile memory when the display is turned off.

4. The process of claim 1, further comprising rewriting the data that are retained in the non-volatile memory into the volatile memory when the display is turned on.

5. The process of claim 1, further comprising operating the display first with uncorrected pixel data and then, after the data is completely rewritten from the non-volatile memory into the volatile memory, operating the display with corrected pixel data (R', G', B') when the display is turned on.

6. The process of claim 1, wherein one or several SDRAM components are used as the volatile memory.

7. The process of claim 1, wherein at least one of flash components, MRAM, FRAM, FeRAM, RRAM, and PCM components is used as the non-volatile memory.

8. The process of claim 1, wherein respectively recorded volume of data is reduced by one of reducing the accuracy of the recorded pixel wear values ($R^{int}$, $G^{int}$, $B^{int}$) or that of the characteristics that are proportional to the recorded pixel wer values ($R^{int}$, $G^{int}$, $B^{int}$), and storing a difference value between the respective pixel wear value ($R^{int}$, $G^{int}$, $B^{int}$) and a predeterminable maximum pixel wear value.

9. The process of claim 1, wherein the intensity of the individual pixels is increased or decreased separately for each of the basic colors red, green, and blue, in dependence upon at least one of respective individually stored pixel wear values ($R^{int}$, $G^{int}$, $B^{int}$) and characteristics that are proportional to the stored pixel wear values ($R^{int}$, $G^{int}$, $B^{int}$).

10. The process of claim 9, wherein the increase or decrease of the intensity of the individual pixels is carried out one of automatically, interactively, and manually in dependence upon predetermined threshold values.

11. The process of claim 9, further comprising generating a correction image for the display from the stored pixel wear values or from characteristics that are proportional to the stored pixel wear values, whose indication on the display equalizes individually different pixel wear values with a general wear level.

12. The process of claim 11, further comprising indicating the correction image on the display is carried out one of automatically, interactively, and manually at predeterminable times in dependence upon predetermined threshold values of the pixel wear value or the characteristics that are proportional to the pixel wear values.

13. The process of claim 11, further comprising operating selected pixels separately to accelerate an equalization of pixel wear values (R*, G*, B*).

14. The process of claim 1, further comprising adding pixel correction data ($R^{kor}$, $G^{kor}$, $B^{kor}$) predetermined by a logic element respectively to the red, green, and blue pixel data (R, G, B), and operating the display with correspondingly corrected pixel data (R', G', B').

15. The process of claim 14, wherein the pixel correction data ($R^{kor}$, $G^{kor}$, $B^{kor}$) are determined with the logic element one of by evaluating the recorded pixel wear data ($R^{int}$, $G^{int}$, $B^{int}$), based on characteristics dependent from the recorded pixel wear data ($R^{int}$, $G^{int}$, $B^{int}$), and by wear characteristic fields stored separately for each of the three basic colors.

16. The process of claim 15, further comprising generating the pixel correction values ($R^{kor}$, $G^{kor}$, $B^{kor}$) at defined time intervals.

17. The process of claim 15, wherein determining the pixel correction data ($R^{kor}$, $G^{kor}$, $B^{kor}$) is carried out in dependence upon at least one of an individual phosphorous characteristic of the display, an overall brightness of the display, an overall brightness of the display in the basic colors red, green, and blue, an operating temperature of the display and a color temperature of the display.

18. The process of claim 14, wherein the display is a master display, the memory element is upgraded in a first step with the volatile and the non-volatile memory, and the display is then additionally operated initially uncorrected with a defined image and is evaluated with regard to the individual wear characteristic of the display, and the individual pixel wear values (($R^{int}$, $G^{int}$, $B^{int}$) are transmitted to the memory elements, the correction data ($R^{kor}$, $G^{kor}$, $B^{kor}$) are determined by means of the logic element(s) that are upgraded if necessary, and are then operated with the corrected image values (R', G', B') to equalize the wear on the display at the individual pixels.

19. The process of claim 1, further comprising scaling graphic data shown on the display by an adaptation of one of a respectively represented resolution to a format of a physical resolution of the display or by deinterlacing.

20. The process of claim 1, wherein the adaptation of different width-to-height ratio of the video source and the display is integrated in the logic element as well as in the process.

21. The process of claim 15, wherein the display comprises a plasma pulse generator, in which the corrected pixel values (R', G', B') determined by the logic element are allocated to the plasma pulse generator and an individual brightness control of the pixels of the display is carried out for each pixel by the plasma pulse generator.

22. The process of claim 15, wherein the display comprises a plasma pulse generator, in which the pixel correction values ($R^{kor}$, $G^{kor}$, $B^{kor}$) determined by the logic element are allocated to this plasma generator, while the pixel data (R, G, B) are supplied unchanged to an RGB graphic data input of the display and an individual brightness control of the pixels of the display is carried out for each pixel by the plasma pulse generator.

23. The process of claim 1 operated in combination with at least one of image shifting, brightness reduction of stills, and the use of inverse images, while the process is operated by a control circuit connected downstream.

24. The process of claim 14, wherein the logic element directly processes multiplexed data.

25. The process of claim 1, wherein controls for limiting the maximum brightness of the display are taken into consideration in that the process receives information from a control mechanism of the display and reproduces this mechanism and carries out the control on its own.

26. The process of claim 14, wherein the display is activated less within a first operating time at least by sections with the aid of the corrected pixel values (R', G', B') and is increasingly more frequently activated at a subsequent operating time with the aid of the corrected pixel values (R', G', B').

27. The process of claim 26, wherein selected pixels are increasingly more frequently activated within the first operating time.

28. The process of claim 14, wherein a process for gamma correction is applied in the logic element and integrated into the process.

29. A wear-afflicted display, comprising:

a plurality of pixels;

a logic element connected to the display; and a memory element, including a volatile memory and a non-volatile memory, wherein the logic element is configured to determine a pixel wear value ($R^{int}$, $G^{int}$, $B^{int}$) that is individual to each of the plurality of pixels, the pixel wear value ($R^{int}$, $G^{int}$, $B^{int}$) being stored in the volatile memory for each basic color including red, green, and blue, the pixel wear value ($R^{int}$, $G^{int}$, $B^{int}$) representing one of an operating time and an operating intensity of a respective pixel (R, G, B) of the display, and wherein a non-volatile stored pixel wear value ($R^{int}$, $G^{int}$, $B^{int}$) corresponds to a sum of the most significant bits of the volatile stored pixel wear value ($R^{int}$, $G^{int}$, $B^{int}$) integrated over the operating time of the pixel, and wherein the logic element is further configured to determine a pixel correction value ($R^{kor}$, $G^{kor}$, $B^{kor}$) that is individual to each pixel, the pixel correction value ($R^{kor}$, $G^{kor}$, $B^{kor}$) being stored in the volatile memory for each basic color red, green, and blue, for the correction of the respective pixel signal (R, G, B), wherein the pixel wear value ($R^{int}$, $G^{int}$, $B^{int}$) and the pixel correction value ($R^{kor}$, $G^{kor}$, $B^{kor}$) being stored in a same memory cell ($R^{vf}$, $G^{vf}$, $B^{vf}$) of the volatile memory, and wherein characteristics that are proportional to the respective pixel wear values are stored in addition to or alternatively to the pixel wear values.

30. The display of claim 29, further comprising a plasma pulse generator configured to control a brightness of the display, based on the pixel correction values ($R^{kor}$, $G^{kor}$, $B^{kor}$) determined based on the pixel wear values ($R^{int}$, $G^{int}$, $B^{int}$) recorded in the memory element or the characteristic corresponding thereto are forwarded to the plasma pulse generator, while otherwise unchanged graphic data (R, G, B) are applied at an RGB input of the display.

31. The display of claim 29, wherein in the case in which display technologies are used, in which individual colors have different wear characteristics, selected colors are applied with a relatively higher color and/or light component in comparison with other colors.

32. The display of claim 29, wherein the logic of a graphic controller is integrated in the logic element so that the volatile memory for a graphic controller and the logic element are jointly usable.

33. A wear-afflicted display comprising:

a plurality of pixels;

a logic element connected to the display; and a memory element, including a volatile memory and a non-volatile memory, wherein the logic element is configured to determine a pixel wear value ($R^{vn}$, $G^{vn}$, $B^{vn}$), the pixel wear value ($R^{vn}$, $G^{vn}$, $B^{vn}$) being non-volatile stored in the non-volatile memory for each basic color including red, green, and blue, wherein the non-volatile stored pixel wear value ($R^{vn}$, $G^{vn}$, $B^{vn}$) corresponds to a sum of the most significant bits of a volatile stored pixel wear value ($R^{vn}$, $G^{vn}$, $B^{vn}$) integrated over the operating time of the pixel, and wherein the less significant bits of the volatile stored pixel value ($R^{vf}$, $G^{vf}$, $B^{vf}$) are retained unchanged in the volatile memory.

* * * * *